US005910477A

United States Patent [19]

Gordon

[11] Patent Number: 5,910,477

[45] Date of Patent: Jun. 8, 1999

[54] VISCOUS CLEANING COMPOSITIONS WITH IMPROVED FOAM COLLAPSE

[75] Inventor: Neil James Gordon, Strombeek-Bever, Belgium

[73] Assignee: The Procter & Gamble Company, Cincinnati, Ohio

[21] Appl. No.: 08/750,190

[22] PCT Filed: May 10, 1995

[86] PCT No.: PCT/US95/05839

§ 371 Date: Feb. 24, 1997

§ 102(e) Date: Feb. 24, 1997

[87] PCT Pub. No.: WO95/33024

PCT Pub. Date: Dec. 7, 1995

[30] Foreign Application Priority Data

May 31, 1994 [EP] European Pat. Off. ..... 94870090

[51] Int. Cl.[6] ..... C11D 1/12; C11D 1/75; C11D 3/30

[52] U.S. Cl. ..... 510/503; 510/101; 510/119; 510/123; 510/124; 510/125; 510/127; 510/128; 510/191; 510/229; 510/237; 510/238; 510/239; 510/245; 510/253; 510/362; 510/363; 510/364; 510/365; 510/373; 510/398; 510/413; 510/414; 510/426; 510/433; 510/477; 510/488; 510/499

[58] Field of Search ..... 510/101, 119, 510/123, 124, 125, 127, 128, 191, 229, 237, 238, 239, 245, 253, 362, 303, 364, 365, 373, 398, 413, 414, 426, 433, 477, 488, 499, 503

[56] References Cited

U.S. PATENT DOCUMENTS

| | | | |
|---|---|---|---|
| H1559 | 7/1996 | Prieto et al. | 510/235 |
| 3,928,249 | 12/1975 | Nunziata et al. | 252/526 |
| 3,943,234 | 3/1976 | Roggenkamp | 424/343 |
| 4,076,800 | 2/1978 | Marsh et al. | 424/70 |
| 4,140,759 | 2/1979 | Mausner | 424/70 |
| 4,235,752 | 11/1980 | Rossall et al. | 252/551 |
| 4,282,109 | 8/1981 | Citrone et al. | 252/102 |
| 4,486,338 | 12/1984 | Ootani et al. | 252/545 |
| 4,614,612 | 9/1986 | Reilly et al. | 252/541 |
| 4,842,771 | 6/1989 | Rorig et al. | 252/547 |
| 4,891,150 | 1/1990 | Gross et al. | 252/142 |
| 5,076,954 | 12/1991 | Loth et al. | 252/122 |
| 5,454,981 | 10/1995 | Sherry et al. | 252/542 |
| 5,612,301 | 3/1997 | Inman | 510/122 |

FOREIGN PATENT DOCUMENTS

| | | | |
|---|---|---|---|
| 092363 | 10/1983 | European Pat. Off. | B01F 17/16 |
| 265979 | 5/1988 | European Pat. Off. | C11D 1/62 |
| 518401 | 12/1992 | European Pat. Off. | C11D 1/83 |
| 2106927 | 4/1983 | United Kingdom | C11D 3/20 |
| 2181738 | 4/1987 | United Kingdom | C11D 3/14 |

*Primary Examiner*—Douglas J. McGinty
*Assistant Examiner*—Charles Boyer
*Attorney, Agent, or Firm*—R. S. Echler, Sr.; B. M. Bolam; K. W. Zerby

[57] ABSTRACT

An aqueous viscous composition comprises: (a) from 0.5% to 1.2% of an ingredient comprising an amine, amine oxide or a mixture thereof; (b) between 4% and 7% of an ingredient comprising a secondary alkyl sulfate, secondary alkyl sulfonate, primary monobranched alkyl sulfate, primary monobranched alkyl sulfonate or mixture thereof, (c) between 2% and 4% hydrotrope; and (d) between 4% and 8% citric acid. The amount of component (b) is in excess of component (a), and the composition has a pH of from 3 to 4. A 1.2%, by weight, aqueous solution of the composition has an average rate of foam collapse of from 1.00 to 1.50 cm/min.

19 Claims, No Drawings

VISCOUS CLEANING COMPOSITIONS WITH IMPROVED FOAM COLLAPSE

TECHNICAL FIELD

The present invention relates to liquid compositions for cleaning hard surfaces.

BACKGROUND

It is well known in the art that it is a desirable feature of a liquid hard surface cleaner that it should have a certain viscosity. Indeed, viscosity allows a controlled handling, more specifically dispensing, of the product during use, as compared to a thinner product. Also, viscosity allows a better action of the product on non-horizontal surfaces, such as toilets, bath tubs and the like. That is because viscosity prevents the product from running down said surfaces, like thinner liquids would. Preferably, viscosity will be built up by a so-called self-thickening system as opposed to using a thickener compound for that specific purpose. Indeed, thickeners, such as gums or polymers have at least one drawback that they affect the formula cost, while providing only one benefit, which is thickening. They do not participate to the actual cleaning of the surface and therefore represent "inert" materials. Also, some thickeners are detrimental to the physical stability of the products they are formulated in. It is known in the art to formulate self thickened compositions where the thickening is achieved without the use of polymeric thickeners, see for instance EP 518 401 and EP 21 581.

But there are some drawbacks associated with viscosity. And a main drawback is that viscous products are typically difficult to rinse away, specifically because viscous products have a good cling onto surfaces and current self thickening systems lead to the formation of stable foams. Thus viscosity and ease of rinsing are somewhat conflicting requirements, but both are desirable in a single product for cleaning hard surfaces. It is thus an object of the present invention to provide a hard surface cleaning composition which is viscous by means of a self thickening system, and which is nevertheless easy to rinse away.

In response we have found that such a composition could be formulated by using an amine oxide, an amine or mixtures thereof, in combination with a secondary or primary monobranched alkyl sulfate or sulfonate in a mildly acidic system further comprising a hydrotrope and citric acid. An additional benefit derived from said compositions is that they are low foaming, both in the sense of the amount of foam initially generated during use, as well as in terms of foam stability. This benefit adds to the ease of rinsing benefit already obtained with the "mechanistic" benefit derived from the viscosity profile of the composition.

SUMMARY OF THE INVENTION

The present invention is an aqueous viscous composition comprising an amine oxide, or an amine or mixtures thereof, a secondary, or primary monobranched alkyl sulfate or sulfonate in excess of said amine oxide, amine or mixtures thereof, a hydrotrope, and an organic acid, said composition being formulated at a pH of from 0.5 to 7.

DETAILED DESCRIPTION OF THE INVENTION

The compositions according to the present invention are aqueous compositions. Therefore they comprise from 90% to 60% by weight of the total composition of water. One of the achievements of the present invention is that the viscosity build up described hereinafter can be achieved with such a high amount of water, i.e. a small amount of actives.

As a second essential ingredient, the compositions herein comprise an amine oxide, or amine, or mixtures thereof. Suitable amine oxides to be used according to the present invention are according to the formula R1R2R3NO, where R1 is a hydrocarbon chain comprising from 6 to 18 carbon atoms, and R2 and R3 are independently hydrocarbon chains comprising up to 3 carbon atoms, or mixtures thereof. Preferred amine oxides for use herein are amine oxides where R1 comprises from 8 to 14 carbon atoms, preferably are C8–C10 amine oxide or C12–C14 amine oxide and R2 and R3 are both methyl. Such a C8–C10 amine oxide is commercially available under the trade name Barlox® 10S, from Lonza. Such a C12–C14 amine oxide suitable to be used herein is commercially available under the name Genanimox® LA from Hoechst. Another suitable amine oxide for use herein which is commercially available is Aromox® DMMCO-W from Akzo. Suitable amines to be used according to the present invention are according to the formula R1R2R3N, where R1 is a hydrocarbon chain comprising from 6 to 18 carbon atoms, and R2 and R3 are independently hydrogen or hydrocarbon chains comprising up to 3 carbon atoms, or mixtures thereof. Preferred amines for use herein are amines where R1 comprises from 8 to 12 carbon atoms and R2 and R3 are independently methyl or hydrogen.

Preferably the total amount of amine oxides, or amines, or mixtures thereof, in the compositions according to the present invention is from 0.3% to 5.0% by weight of the total composition, more preferably 0.5% to 1.2%.

As a third essential ingredient, the compositions herein comprise a secondary, or primary monobranched alkyl sulfate or sulfonate, or mixtures thereof. By secondary alkyl sulfate or sulfonate, it is meant herein an alkyl sulfate or sulfonate where the alkyl chain comprises from 10 to 16 carbon atoms, preferably from 12 to 14, and where this alkyl chain is not sulfated or sulfonated at either terminus. By primary monobranched sulfate or sulfonate, it is meant herein an alkyl sulfate or sulfonate where the alkyl chain comprises from 10 to 16 carbon atoms, preferably from 12 to 14, and where this alkyl chain is branched, comprises an alkyl substituent, at least one carbon removed from the sulfate or sulfonate group, i.e. in position 2 or further on the alkyl chain, numbering from the sulfate or sulfonate group. We have found that it is essential to have a branched alkyl chain, i.e. using a linear alkyl chain does not provide the benefits according to the present invention, but it appears that it does not matter which branching is present in the alkyl chain. We have obtained good results using an alkyl sulfate where the alkyl chain comprised a total of 12 carbon atoms, sodium 2-butyl octyl sulphate. Such an alkyl sulfate is commercially available from Condea under the trade name Isofol® 12 S. An example of an alkyl sulphonate would be Hostapur® SAS available from Hoechst. The amount of secondary, or primary monobranched alkyl sulfate or sulfonate present in the compositions herein depends amongst other things on the amount of amine oxide, or amine or mixtures thereof present, but suitable amounts of secondary, or primary monobranched alkyl sulfates or sulfonates herein are generally comprised between 3% and 20% by weight of the total composition, preferably between 4% and 7%. It is essential that the compositions herein should comprise said secondary, or primary monobranched alkyl sulfate or sulfonate in excess of amine oxide, amine or mixtures thereof, i.e. in the compositions herein, the amount of alkyl sulfate or sulfonate should be greater than the amount of amine oxide, amine or mixtures thereof.

As a fourth essential ingredient, the compositions herein comprise an organic acid, or mixtures thereof. Preferably, the organic acids for use herein will have a pK of less than 6. Suitable such organic acids are selected from the group consisting of citric acid, lactic acid, glycolic acid, succinic acid, glutaric acid and adipic acid, and mixtures thereof. A mixture of said acids suitable for use herein is commercially available from BASF under the trade name of Sokalan® DCS. A preferred acid for use herein is citric acid. Such acids have been found to provide the desired benefit in viscosity build up as well as composition stability. We have found that no phase separation occurred for at least 30 days at 20° C., and up to 30 days at 50° C. in the case of citric acid. The amount of organic acid herein may vary depending on the amount of other ingredients herein, but suitable amounts of acids herein are generally comprised between 1 % and 20% by weight of the total composition, preferably between 4% and 8%, particularly when citric acid is used.

The fifth essential ingredient herein is a hydrotrope. By hydrotrope, it is meant herein an agent which helps solubilizing the hydrophobic ingredients in the compositions. We have found that the hydrotrope participates to the building of the viscosity and contributes to increase the stability of the composition. Suitable hydrotropes for use herein include nonionic surfactants and organic solvents, and mixtures thereof. Suitable nonionics for use herein are alkoxylated alcohols generally comprising from 6 to 16 carbon atoms in the 20 alkyl chain of the alcohol. Typical alkoxylation groups are ethoxy and propoxy groups. Such compounds are commercially available under the series Dobanol® from Shell, or Lutensol® from BASF with a wide variety of chain length and alkoxylation degrees. Preferred nonionic surfactants for use herein are according to the formula R(X)nH, were R is an alkyl chain having from 6 to 16 carbon atoms, preferably 6 to 10, X is an alkoxy group, preferably ethoxy or a mixture of ethoxy and propoxy, n is an integer of from 4 to 30 preferably 5 to 8. Suitable solvents for use herein are organic solvents, preferably alcohols or ethers thereof, or mixtures thereof. Commonly available solvents which are suitable for use herein include normal-butoxy propoxy propanol (n-BPP), propane diol and butyl diglycol ether (BDGE). The amount of hydrotrope may vary depending on the amount of other ingredients herein, but suitable amounts of hydrotrope herein are generally comprised between 1% and 10% by weight of the total composition, preferably between 2% and 4%.

The sixth essential feature herein is the pH, which is required to be of from 0.5 to 7. But we have observed that, as the compositions herein are formulated close to the higher end of this pH range, the lower the overall solubility of the composition, thus the more difficult it is to incorporate hydrophobic ingredients, typically perfumes. Also, beyond pH 7, we have not been able to provide the desired viscosity. At the opposite end, as the pH gets low a higher amount of the amine oxide described hereinbefore is needed. A preferred pH range herein is of from about 2 to 6, most preferably 3 to 4.

The compositions herein can be made by mixing together all ingredients keeping as the last one the amine oxide, or amine or mixtures thereof, or the secondary, or primary monobranched alkyl sulfate or sulfonate. Until this last ingredient is added, no or little viscosity build up is observed. Then, upon adding the amine oxide, amine or mixtures thereof, or the secondary, or primary monobranched alkyl sulfate or sulfonate, an opaque solution is formed which thickens on the complete addition of all components. This opaque solution becomes less opaque on thickening. And in some cases transparent products have been obtained. Under an optical microscope the opacity can be seen to be due to a bicontinuous phase, which on thickening, we speculate, leads to the formation of tightly packed vesicles which provides the desired viscosity. It would appear that there remains a non-solubilized component present. The compositions herein eventually reach a viscosity of from 50 cps to 5000 cps at 60 RPM shear rate with spindle #2 with a Brookefield viscometer, preferably from 100 cps to 300 cps.

In this system, it is believed that the amine oxide and/or amine are protonated, due to the acidic pH, and form an ion pair with the secondary alkyl sulfate or sulfonate in the system. This ion pair constitutes a hydrophobic specie. We speculate that the secondary alkyl sulfate, which is present in excess, in combination with the hydrotrope/hydrotropic species and the organic acid, forms an extended/network structure within the aqueous phase. This leads to the thickening of the composition to provide the desired viscosity. Additionally, the presence of the hydrophobic ion pair per se appears to confer antifoaming properties, thus leading to a rinsing benefit.

As an optional but highly preferred ingredient, compositions herein will comprise a perfume ingredient, usually a mixture of such ingredients. Indeed, perfume ingredients which are typically hydrophobic materials has been found to provide a contribution to building viscosity, perhaps through supporting the phase structure of the product, as well as improving the overall stability of the product. By perfume, it is meant herein constituents of a perfume which are added thereto only or primarily for their olfactive contribution. Perfume components may be natural products such as essential oils, absolutes, resinoids, resins, concretes, etc., and synthetic perfume components such as hydrocarbons, alcohols, aldehydes, ketones, ethers, acids, acetals, ketals, nitriles, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butylcyclohexyl acetate, isononyl acetate, vetiveryl acetate, vetiverol, alpha-n-amylcinammic aldehyde, alpha-hexyl-cinammic aldehyde, 2-methyl-3-(p-tertbutylphenyl)-propanal, 2-methyl-3(p-isopropylpheny)propanal, 3-(p-tertbutylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptyl-cyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dietyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk. Compositions herein typically comprise from 0.1% to 2% by weight of the total composition of a perfume ingredient, or mixtures thereof, preferably from 0.1% to 1.0%.

The compositions herein may comprise a variety of other ingredients, including further actives as well as mere aesthetical ingredients such as dyes and the like. In particular the rheology of the compositions herein would be suitable for suspending particles in the composition, e.g. particles of abrasives.

EXAMPLES—EXPERIMENTAL DATA

The present invention is further illustrated by the following examples and data. The following compositions are made by mixing the listed ingredients in the listed proportions in the listed order of addition.

| Ingredient | Formula 1 | 2 | 3 | 4 | 5 | 6 | 7 | 8 | 9 |
|---|---|---|---|---|---|---|---|---|---|
| Citric acid | 5.50 | | 5.50 | 5.50 | 5.50 | 5.50 | 5.50 | 9.50 | 4.00 |
| Lactic acid | | 5.50 | | | | | | | |
| Isofol 12S ® | | | 2.00 | | | | | | |
| Alkyl sulfate (based on Lial alcohol) | | | 2.00 | | | | | | |
| Alkyl sulfate (based on Isalchem 123 ® alcohol) | 4.00 | 4.00 | | | 4.00 | 4.00 | 4.00 | 7.50 | 4.00 |
| Hostapur SCS ® | | | | 4.00 | | | | | |
| Ammonia (as $NH_4OH$) | 0.75 | 0.20 | 0.50 | 0.50 | 0.50 | 0.40 | 1.65 | 0.80 | 0.33 |
| Propane diol | | 1.30 | | | 1.30 | 1.30 | 1.30 | 2.40 | |
| Dobanol 79-6 ® | 3.00 | 3.00 | 3.00 | 3.00 | | | 3.00 | 5.60 | |
| Lutensol AO30 ® | | | | | | 3.00 | | | |
| n-BPP | | | | | 3.00 | | | | 2.50 |
| Perfume | 0.60 | 0.60 | 0.60 | 0.60 | 0.60 | 0.60 | 0.60 | 1.12 | 0.50 |
| C8–10 Dimethylamine oxide | 0.90 | 1.10 | 0.80 | 1.10 | 0.45 | 4.40 | 0.30 | 1.50 | |
| C12 alkyl amine | | | | | | | | | 1.10 |
| pH | 4.0 | 3.0 | 3.2 | 3.2 | 3.2 | 3.2 | 6.0 | 3.2 | 3.7 |
| Viscosity, cps (60 rpm, spindle#2, Brookfield, 20° C.) | 140 | 300 | 170 | 185 | 140 | 350 | 135 | 940 | 140 |

All the above formulations are indicated as % by weight with the remaining portion being water. All of the above formulations were stable. In the examples hereinabove, Lial alcohol (from Enichem) is C12–15 alcohol, 50% branched and 50% linear. We used the sodium salt of the sulfate made from this material. Isalchem 123® (from Enichem), is a C12–13, which is 94% branched. The material can be described as $CH_3—(CH_2)m—CH(CH_2OSO_3Na)—(CH_2)n—CH_3$ where n+m=8–9. Isofol 12S® (From condea) is Sodium 2-butyl octyl sulfate. Hostapur SAS® is C12–16 Sodium paraffin sulfonate. Lutensol® AO 30 is a C13–15 alcohol ethoxylated with average 30 moles ethylene oxide per mole alcohol.

Ease of rinsing is simulated under laboratory conditions by measuring the foam generated from a dilute solution of the product in water (1.2% by weight). The foam height generated after a sponge is soaked and squeezed in the solution 10 times is recorded, as well as the rate of foam collapse. Compositions 1 to 8 above according to the present invention are compared to a commercially available, self thickened composition comprising the following ingredients:

| | |
|---|---|
| Primary C12–14 - sodium alkyl sulphate | 3.40% |
| Citric acid | 5.50% |

-continued

| | |
|---|---|
| Ammonium hydroxide | 0.30% |
| Dobanol ® 23-3 (C12–13 alcohol ethoxylated with average 3 moles of ethylene oxide/mole alcohol) | 0.85% |
| Triethanolamine | 1.90% |
| Perfume | 0.40% |
| Minors and Water | Balance |

The results were as follows:

| Product: | Foam height (cm) | Rate of foam collapse (average cm/min) |
|---|---|---|
| Ref | 4.5 | 0.25 |
| 1 | 4.0 | 1.40 |
| 2 | 3.5 | 1.50 |
| 3 | 4.0 | 1.00 |
| 4 | 3.5 | 1.50 |
| 5 | 3.0 | 1.40 |
| 6 | 3.5 | 1.50 |
| 7 | 4.0 | 1.20 |
| 8 | 5.5 | 1.30 |

The above results show that for each and everyone of the compositions formulated in the above examples, there was less foam generated, and the foam which was generated collapsed quicker, overall providing an easier rinsing.

I claim:

1. An aqueous viscous composition comprising:

(a) from 0.5% to 1.2% of an ingredient comprising an amine, amine oxide or a mixture thereof;

(b) between 4% and 7% of an ingredient comprising a secondary alkyl sulfate, secondary alkyl sulfonate, primary monobranched alkyl sulfate, primary monobranched alkyl sulfonate or mixture thereof;

(c) between 2% and 4% hydrotrope; and (d) between 4% and 8% citric acid;

wherein the amount of component (b) is in excess of component (a), the composition has a pH of from 3 to 4 and wherein a 1.2%, by weight, aqueous solution of the composition has an average rate of foam collapse of from 1.00 to 1.50 cm/min.

2. A composition according to claim 1, further comprising from 60% to 90%, by weight, water and wherein the composition exhibits no phase separation for at least 30 days at 20° C.

3. A composition according to claim 2, wherein the organic acid is citric acid and further wherein the composition exhibits no phase separation for at least 30 days at 50° C.

4. A composition according to claim 1, further comprising an abrasive.

5. A composition according to claim 1, wherein component (a) comprises an amine oxide having the formula $R^4R^5R^6NO$ wherein $R^4$ is a hydrocarbon chain comprising from 6 to 18 carbon atoms, and $R^5$ and $R^6$ are each independently hydrogen or a hydrocarbon chain comprising up to 3 carbon atoms; and component (b) comprises a $C_{12-13}$ 2-alkyl sodium sulfate having the formula $CH_3—(CH_2)m—CH(CH_2OSO_3Na)—(CH_2)n—CH_3$, wherein n+m=8–9.

6. A composition according to claim 1, wherein the composition has a viscosity of from 50 cps to 5000 cps at 60 RPM shear rate.

7. A composition according to claim 1, wherein the hydrotrope is selected from the group consisting of nonionic surfactants, solvents and mixtures thereof.

8. A composition comprising, by weight;

(a) from 0.3% to 5.0% of an amine having the formula $R^1R^2R^3N$, where $R^1$ is a hydrocarbon chain comprising from 6 to 18 carbon atoms, and $R^2$ and $R^3$ are each independently hydrogen or a hydrocarbon chain comprising up to 3 carbon atoms, or mixtures thereof;

(b) from 3% to 20% of a secondary alkyl sulfate, secondary alkyl sulfonate, primary monobranched alkyl sulfate, primary monobranched alkyl sulfonate or mixture thereof;

(c) between 1% and 10% hydrotrope;

(d) between 1% and 20% organic acid; and (e) from 60% to 90% water;

wherein the amount of component (b) is in excess of component (a), and the composition has a pH of from 3 to 4.

9. A composition according to claim 8, further comprising an amine oxide.

10. A composition according to claim 8, wherein the organic acid is citric acid and further wherein the composition exhibits no phase separation for at least 30 days at 50° C.

11. A composition according to claim 8, wherein component (b) comprises a $C_{12-13}$ 2-alkyl sodium sulfate having the formula $CH_3—(CH_2)m—CH(CH_2OSO_3Na)—(CH_2)n—CH_3$, wherein n+m=8–9.

12. A composition according to claim 8, wherein component (a) comprises an amine having the formula $R^1R^2R^3N$, wherein $R^1$ is a hydrocarbon chain comprising from 8 to 12 carbon atoms, and $R^2$ and $R^3$ are each independently hydrogen or methyl.

13. A composition comprising, by weight:

(a) from 0.5% to 1.2% of an ingredient comprising:

(i) amine having the formula $R^1R^2R^3N$, wherein $R^1$ is a hydrocarbon chain comprising from 6 to 18 carbon atoms, and $R^2$ and $R^3$ are each independently hydrogen or a hydrocarbon chain comprising up to 3 carbon atoms;

(ii) amine oxide having the formula $R^4R^5R^6NO$, wherein $R^4$ is a hydrocarbon chain comprising from 6 to 18 carbon atoms, and $R^5$ and $R^6$ are each independently hydrogen or a hydrocarbon chain comprising up to 3 carbon atoms; or (iii) mixtures thereof;

(b) from 3% to 20% of a secondary alkyl sulfate, secondary alkyl sulfonate, primary monobranched alkyl sulfate, primary monobranched alkyl sulfonate or mixture thereof;

(c) between 1% and 10% of a hydrotrope;

(d) between 1% and 20% of a organic acid; and (e) from 60% to 90% water;

wherein the composition has a pH of from 3 to 4 and exhibits no phase separation for at least 30 days at 20° C.

14. A composition according to claim 13, wherein the organic acid is citric acid and further wherein the composition exhibits no phase separation for at least 30 days at 50° C.

15. A composition according to claim 13, wherein component (b) comprises a $C_{12-13}$ 2-alkyl sodium sulfate having the formula $CH_3—(CH_2)m—CH(CH_2OSO_3Na)—(CH_2)n—CH_3$, wherein n+m=8–9.

16. A composition according to claim 13, wherein the hydrotrope comprises a nonionic surfactant having the formula $R(X)_nH$, wherein R is an alkyl chain having from 6 to 16 carbon atoms, X is an alkoxy group and n is an integer of from 4 to 30.

17. A composition according to claim 13, wherein component (a) comprises an amine having the formula $R^1R^2R^3N$, where $R^1$ is a hydrocarbon chain comprising from 6 to 18 carbon atoms, and $R^2$ and $R^3$ are each independently hydrogen or a hydrocarbon chain comprising up to 3 carbon atoms.

18. A composition according to claim 13, wherein the composition has a viscosity of from 50 cps to 5000 cps at 60 RPM shear rate, and wherein a 1.2%, by weight, aqueous solution of the composition has an average rate of foam collapse of from 1.00 to 1.50 cm/min.

19. A composition according to claim 13, further comprising an abrasive.

* * * * *